United States Patent [19]

Clark et al.

[11] 4,205,483

[45] Jun. 3, 1980

[54] DELAYED RETURN DEVICES

[76] Inventors: Lloyd D. Clark, 15 Conrad St., San Francisco, Calif. 94131; David Pressman, 1237 Chestnut St., San Francisco, Calif. 94109

[21] Appl. No.: 867,763

[22] Filed: Jan. 9, 1978

[51] Int. Cl.[2] ..... A63H 29/10

[52] U.S. Cl. ..... 46/41; 46/155; 220/335

[58] Field of Search ..... 46/155, 41, 42, 116, 46/100, 1 R, 134, 130; 220/334, 335; 40/406; 49/29, 30, 387

[56] References Cited

U.S. PATENT DOCUMENTS

| | | | |
|---|---|---|---|
| 2,100,372 | 11/1937 | Barton | 46/134 |
| 2,585,780 | 2/1952 | Johnson | 46/155 X |
| 3,517,933 | 6/1970 | Malkin | 46/100 X |
| 3,757,460 | 9/1973 | Morrison | 46/41 |
| 3,828,462 | 8/1974 | Morrison et al. | 46/41 |
| 3,877,697 | 4/1975 | Lersch | 46/155 X |

FOREIGN PATENT DOCUMENTS

| | | | |
|---|---|---|---|
| 411669 | 4/1925 | Fed. Rep. of Germany | 46/155 |

OTHER PUBLICATIONS

"Paperweight-Timer", Brookstone Co. Catalog, Fall 1976, p. 27.

*Primary Examiner*—Russell R. Kinsey
*Assistant Examiner*—Mickey Yu

[57] ABSTRACT

A device in which a displaced member will automatically return to its rest position after a delay comprises a container partially filled with a viscous fluid. The container is mounted so that it can be moved between a first, stable (rest) position and a second, semistable position in which the fluid will flow slowly away from its rest position. When the fluid has moved away from its rest position sufficiently, it will cause the center of gravity of the container to shift to one side of a pivot, whereupon the container will make an automatically delayed return to its first position. The container is employed as a box lid which will close automatically a predetermined time after being opened so that it can be used as an interval timer and/or a scent release mechanism. The container is also mounted in a human novelty figure in such a manner that if it is tipped over it will return automatically to an upright position after a predetermined delay.

10 Claims, 4 Drawing Figures

CLOSED AND FIRST OPENED

ABOUT TO CLOSE

CLOSING

DELAYED RETURN DEVICES

FIELD OF INVENTION

This invention relates to a delayed return mechanism or timer and particularly to such a mechanism which can be used to perform a variety of delay functions.

PRIOR ART

Heretofore interval timers comprised either mechanical, electronic, or other mechanisms in which the end of a predetermined interval was signaled by a bell, absence of sand in the top half of an hour-glass, etc. The timer performed only a single function, i.e., that of timing the interval, and the delayed-return member of the timer usually moved only a small amount.

Accordingly two objects of the present invention are to provide a timer which can perform additional functions inherently with its timing mechanism and to provide a timing mechanism in which the delayed-return member moves a relatively large amount.

Heretofore scent releasing mechanisms comprised either complicated electromechanical timing mechanisms or manual mechanisms which had to be activated and terminated manually. Examples of such manual mechanisms are incense, which had to be lit manually, and commercial air freshener devices, in which a wick was extended or a container opened; however in these mechanisms the scent-producing material had to be extinguished or closed or else it would be completely consumed through evaporation or combustion.

Accordingly it is another object of the invention to provide a self-timing scent release mechanism. A further object is to provide a novelty device in which a tipped-over human figure will return to its upright position after a predetermined interval. Still further objects and advantages of the invention will become apparent from a consideration of the ensuing description thereof.

DRAWINGS

LIST OF REFERENCE NUMERALS

10—box
12—feet of box
14—scent release material
16—flowers
18—lid
20—viscous fluid
22—pivot points
24—motion lines
26—vertical plane through pivots
28—lid stops
30—bumpers
32—human figure
34—base of figure
36—container in figure
38—pivot of figure

Figure 1:
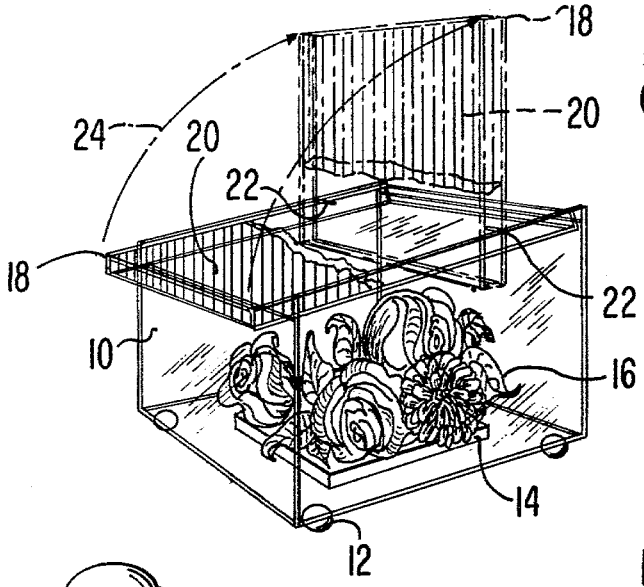
FIG. 1 is a perspective view of a box according to the invention in which a lid is closed and then (phantom view) opened.
Figure 2:
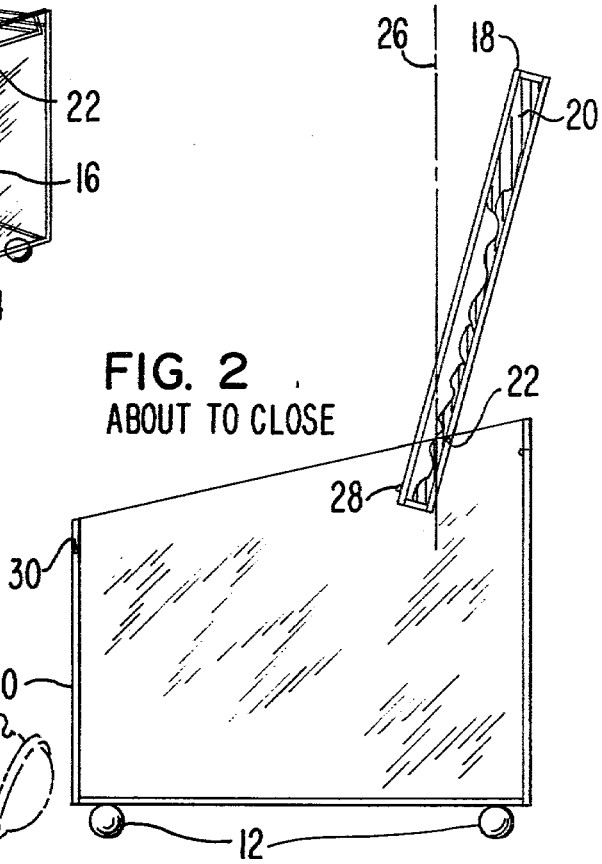
FIG. 2 is a side view of the box with the lid in the open position and about to close.
Figure 3:
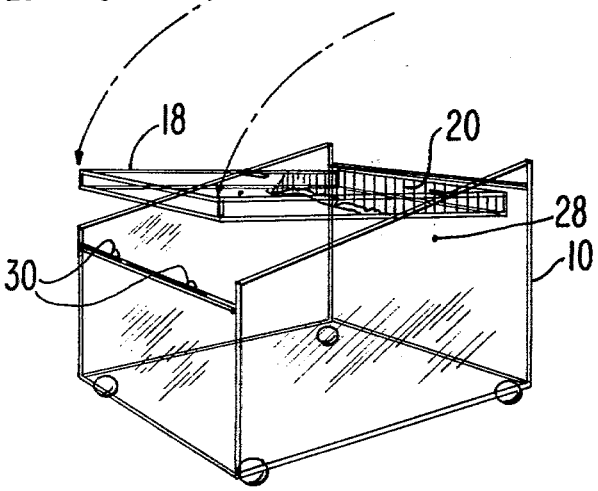
FIG. 3 is a perspective view of the box when the lid is closing.

DESCRIPTION—FIGS. 1 to 3

According to one embodiment of the invention, a box 10, preferably of a transparent sheet material such as that sold under the trademarks LUCITE, PLEXIGLAS, LEXAN, etc., has a rectangular shape and rests on four ball-shaped feet, such as 12. Inside the box, which is positioned on a planar, horizontal surface (not shown), is a block of sublimatory scent-release material 14 having an attractive decoration thereon, such as plastic flowers 16. The box is normally covered by a lid 18 so that scent material 14 will not evaporate.

According to the presently-preferred embodiment of the invention, lid 18 consists of a flat rectangular enclosure which is partially filled with a viscous, transparent or translucent colored fluid. Fluid 20 is lined for the color red, but any other color may be used, including clear. Suitable viscous fluids are heavy oils, gelatines, etc., but preferably liquid silicone such as that sold under the trademark DC-200 and manufactured by Dow Chemical Company, Midland, Mich., is employed. The remainder of enclosure 18 preferably is filled with another fluid, such as air, which has no significant effect upon the flow properties of fluid 20, but in lieu of air, a viscous fluid which is immiscible with fluid 20 may be employed to enhance the apparent viscosity of fluid 20.

As best shown in FIG. 2, the top of box 10 slopes forward so that when lid 18 is in its closed position, fluid 20 will assume a stable rest position in the forward portion of lid 18 as indicated in FIG. 1.

Lid 18 is pivoted within the sides of box 10 at two pivot points 22 which are spaced back from the vertical median (not shown) of box 10 and lid 18 in its closed position. When lid 18 is lifted from the front edge thereof and rotated backwardly as indicated by lines 24 (FIG. 1) it can be rotated backwards as far as the position shown in FIG. 2 where it is limited by stops 28. In this position lid 18 will remain tilted backward as long as fluid 20 remains in its rest position in lid 20. This is because the major portion of fluid 18 will be on the rear side of a vertical plane 26 which intersects pivots 22, thereby causing the lid's center of gravity to be on the rear side of pivots 22.

OPERATION—FIGS. 1 to 3

When it is desired to open box 10 to release the scent of block 14 temporarily, or to time an event, such as a long distance telephone conversation, lid 18 is rotated to the upright and tiltedback position shown in FIG. 2. As stated, in this position the center of gravity of lid 18 is to the right or rear of plane 26 because most of fluid 20, which accounts for a large portion of the weight of lid 18, is to the rear of plane 26. Lid 18 will remain in its upright position as long as fluid 20 retains its rest position in lid 18.

Due to the force of gravity, fluid 20 will creep downward from its upward (or rest) position (phantom view of FIG. 1) toward the bottom portion of lid 18. After several minutes, when enough fluid has crept down to cause the center of gravity of lid 18 to shift to the left-hand side of plane 26 (FIG. 2), the left portion of lid 18 with respect to plane 26 will become heavier and lid 18 will automatically return to its original position as shown in FIG. 3. It has been found that lid 18 can be made to flip closed rapidly or more gradually by adjusting the positions of pivot points 22. Bumpers 30 are provided at the top edge of the front panel of box 10 to cushion the return of lid 18.

After lid 18 closes, fluid 20 will flow back to its rest position due to the forward slope of lid 18, as shown in the full view of FIG. 1.

DESCRIPTION AND OPERATION—FIG. 4

Figure 4:
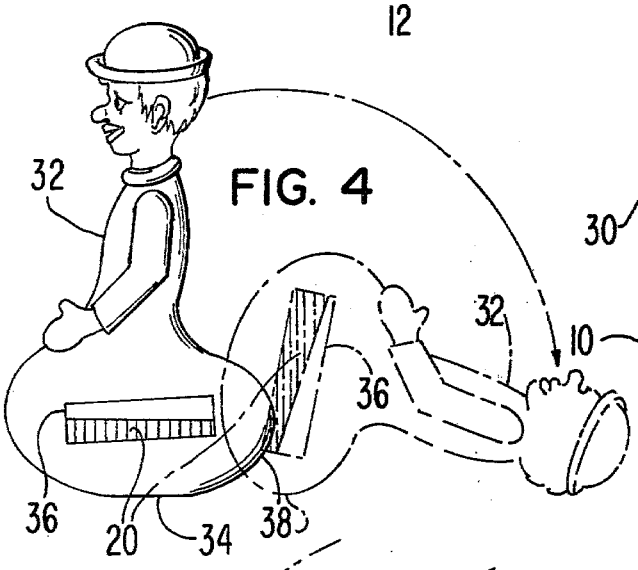
FIG. 4 is a view of a novelty figure in upright and then (phantom view) supine positions.

In the embodiment of FIG. 4, which is positioned on a planar, horizontal surface (not shown) a human or other upright FIG. 32 will be self-uprighting after a predetermined delay if it is tipped over to a supine position. FIG. 32 has a broad base 34 which is flat or slightly curved so that it will stand in an upright position as shown in the full view. The shapes of the head and torso of FIG. 4 as seen from the top are not indicated but preferably are generally oval and rectangular, respectively, similar to those of an actual human, but both can alternatively be circular for a novelty effect, as in the familiar boxing figure which cannot be tipper over. FIG. 32 may be solid or hollow and may be made of wood, plastic, etc., preferably opaque. It includes a container 36 mounted in a recess or by supports (not indicated) in its base. The bottom right-hand corner 38 of the figure is curved to provide a smooth pivot so that FIG. 32 can be rotated smoothly back and forth from a supine position (shown in the phantom view) and its upright position (full view).

Container 36 preferably is similar in configuration to or somewhat narrower than lid 18 of FIG. 1; like lid 18 it is partially filled with viscous fluid 20. Container 36 is mounted in such a position that when FIG. 32 is supine and fluid 20 is in its rest position in container 36, the center of gravity of FIG. 32 will be to the right of pivot 38 so that FIG. 32 will remain supine.

However when FIG. 32 is rotated back on pivot 38 to its supine position (phantom view), fluid 20 will creep downward, away from its rest position in container 36. When enough fluid has crept to shift the center of gravity to the left of pivot 38, the figure will return automatically to its upright position. Due to inertia the figure may tip somewhat forward in returning, but its base is broad and heavy enough to upright it again.

To enhance the novelty effect, FIG. 32 may be painted or designed to resemble an inebriate or a zombie which can be "revived" by a magician reciting incantations long enough to allow fluid 20 time to act.

RAMIFICATIONS

The box embodiment of FIGS. 1 to 3 can serve a dual function if the viscosity of fluid 20 and the size of the enclosure formed by lid 18 are preferably selected so that lid 18 will remain open for 3 minutes at room temperature (20° C.) so that a long distance telephone conversation can be timed while scent is released. However if it is desired to release the scent for a longer time, the viscosity of fluid 20 should be increased and/or a narrower enclosure for lid 18 should be provided; thereby the semistable open position of lid 18 may be extended to ten minutes and upward.

While lid 18 and box 10 are shown as rectangular, it will be appreciated that other shaped lids and boxes may alternatively be used, such as circular, oval, etc.

In lieu of being shaped to contain a scent releasing material 14, box 10 may be shaped to contain other materials, such as postage stamps, paper clips, smoking materials, ice (box 10 would be insulated), cookies, bread, candy, etc. Where it is desired to prevent a pet animal from overeating, and the animal is of insufficient intelligence to lift lid 18 on its own, box 10 may be employed as a pet food storage and feeder box which will close automatically after an interval sufficient to give the pet opportunity to eat a proper amount of food. Although lid 18 may close on the pet's head, it is not heavy enough and does not accelerate to a fast enough rotational speed to injure the pet.

Lid 18 also may be connected to operate an electrical switch so that an electrically-operated function, such as an odor absorbing vacuum device, or a lamp (both of which would turn off automatically when the lid closes) may be provided. Box 10 may also be an ashtray; lid 18 would thereby close to extinguish lit smoking materials.

While the invention has been described in terms of an automatic closure of a lid for a box, or self-uprighting figure, it may be employed in other rotational forms, such as a mechanism which will lift an egg out of hot water when sufficient time has elapsed to cook the egg to a soft-boiled condition, or an abstract modernistic design.

In addition to a rotational application, the invention can also be employed to effect a combination of translational and rotational motions. In this case the container could be slid along a curved track to a semistable position in which fluid 20 would flow gradually to a position which would shift the center of gravity of the container to a position which then would cause the lid to return along the track to its original position.

While the lid has been shown as employing a liquid fluid 20, a particulate solid fluid, such as fine sand or microscopic aluminum oxide, which has rheological properties similar to a viscous liquid fluid may be employed, either alone or with a container having a constricted center portion. Thus the term "viscous fluid" includes solids having fluid properties.

While the above description contains many specificities, these should not be construed to limit the scope of the invention, but rather to exemplify the preferred and several other embodiments thereof. The true scope of the invention should be determined only by the appended claims and their legal equivalents.

We claim:

1. A device which contains an enclosure which automatically returns to a stable position a predetermined interval after said enclosure is moved to a different, semistable position, said device comprising:

A. said enclosure and a viscous fluid partially filling said enclosure, and

B. means for mounting said enclosure to said device so that, while said device is positioned on a planar, horizontal surface:

(1) said enclosure can be moved to either said stable or said semistable positions, (2) said enclosure, when in said stable position:

(a) will remain thereat indefinitely regardless of the position of said fluid in said enclosure, and (b) said enclosure will be so oriented with respect to said horizontal surface that said fluid will flow to a predetermined rest position and shape in one portion of said enclosure, (3) said enclosure, when moved to said semistable position:

(a) will remain thereat so long as said fluid remains in its rest position and shape in said one portion of said enclosure, but (b) said fluid gradually will flow away from said rest position and shape and thereby shift the center of gravity of said enclosure so as to cause said enclosure to return automatically to its original stable position when said center of gravity has shifted a predetermined amount; and (4) after returning to its original stable position, the fluid in said enclosure will flow back to its rest position and shape in said one portion of said enclosure so as to reset said device automatically, said fluid having a sufficient viscosity and said enclosure being shaped so that, at least at one predetermined temperature, when said enclosure is in said stable position and said fluid has assumed its rest position and shape in said one portion of said enclosure and said enclosure is then moved to said semistable position, it will remain in said semistable position for said predetermined interval before returning to said stable position.

2. The device of claim 1 wherein said means for mounting said enclosure comprises pivot means for enabling said enclosure to rotate between said first and second positions.

3. The device of claim 2 wherein said enclosure is shaped to form a container lid and including a container which can be closed by said lid, said enclosure substantially sealing an open side of said container when in said first position and leaving said container substantially open when in said second position.

4. The device of claim 3 wherein said enclosure is pivotably mounted to said open side of said container.

5. The device of claim 4 wherein said container is a box having an open top and said enclosure is pivotably mounted to opposite side walls of said box along an axis spaced from the centerline of said box and said enclosure.

6. The device of claim 5 wherein, in the second position of said enclosure, the major portion thereof on one side of said axis is tilted away from a vertical plane intersecting said axis and on the side of said plane opposite the major portion of said box.

7. The device of claim 4 wherein said container contains a scent-emitter.

8. The device of claim 2 wherein said enclosure is attached to a figure, resembling a human, said figure having a relatively broad base so that it will stand upright on said base, said figure having a pivot on said base and said enclosure being positioned such that if said figure is tipped to a recumbent position about said pivot, said figure will remain recumbent for an interval and will thereafter return about said pivot to an upright position due to flow of fluid in said enclosure away from its rest position.

9. The device of claim 1 wherein said enclosure is formed of a material which will permit said fluid therein to be seen through said enclosure, said fluid being colored contrastingly to said enclosure.

10. The device of claim 1 wherein said fluid is a silicone and the portion of said enclosure not containing said fluid is filled with air.

* * * * *